US005458411A

United States Patent [19]

Moss

[11] Patent Number: 5,458,411

[45] Date of Patent: Oct. 17, 1995

[54] DISPLAY SHELF UNIT

[75] Inventor: William F. Moss, Canonsburg, Pa.

[73] Assignee: Union Camp Corporation, Canonsburg, Pa.

[21] Appl. No.: 128,648

[22] Filed: Sep. 30, 1993

[51] Int. Cl.[6] ..... A47B 3/00

[52] U.S. Cl. ..... 312/259

[58] Field of Search ..... 312/258, 259, 312/253; 211/85, 135, 186; 108/153, 165, 162, 180

[56] References Cited

U.S. PATENT DOCUMENTS

| | | | |
|---|---|---|---|
| 2,062,165 | 11/1936 | Davidson | 211/135 |
| 2,801,754 | 8/1957 | Dorfman | 108/100 |
| 3,141,555 | 7/1964 | Funke et al. | 211/135 |
| 3,648,626 | 3/1972 | Schuster | 108/42 |
| 4,311,100 | 1/1982 | Gardner et al. | 211/135 X |
| 4,373,449 | 2/1983 | Klaus et al. | 108/60 |
| 4,506,790 | 3/1985 | Muscari | 108/180 X |
| 4,519,319 | 3/1985 | Howlett | 108/180 |
| 4,582,283 | 4/1986 | Schmitt | 248/174 |
| 5,143,431 | 9/1992 | Udell | 312/259 |
| 5,154,392 | 10/1992 | Voight | 248/558 |
| 5,213,220 | 5/1993 | McBride | 211/132 |
| 5,315,936 | 5/1994 | Smith | 108/165 |

*Primary Examiner*—James R. Brittain
*Assistant Examiner*—Robert J. Sandy
*Attorney, Agent, or Firm*—Dennis H. Lambert

[57] ABSTRACT

An inexpensive, strong, and easy to assemble display shelf unit made from folded blanks of corrugated liner board, includes a base member having a back panel with side panels extending forwardly from opposite edges thereof. Each side panel has a plurality of flaps on its free edge folded inwardly and rearwardly alongside the respective side panel to define a plurality of generally vertically aligned pockets. A plurality of shelf units extend between the side panels and are made from folded blanks of corrugated liner board. Each shelf unit has a downturned flap on its opposite end engaged in a respective pocket to support the shelf units on the base. Shelf supports are engaged between adjacent shelf units at approximately their midportion to reinforce the shelf units.

18 Claims, 9 Drawing Sheets

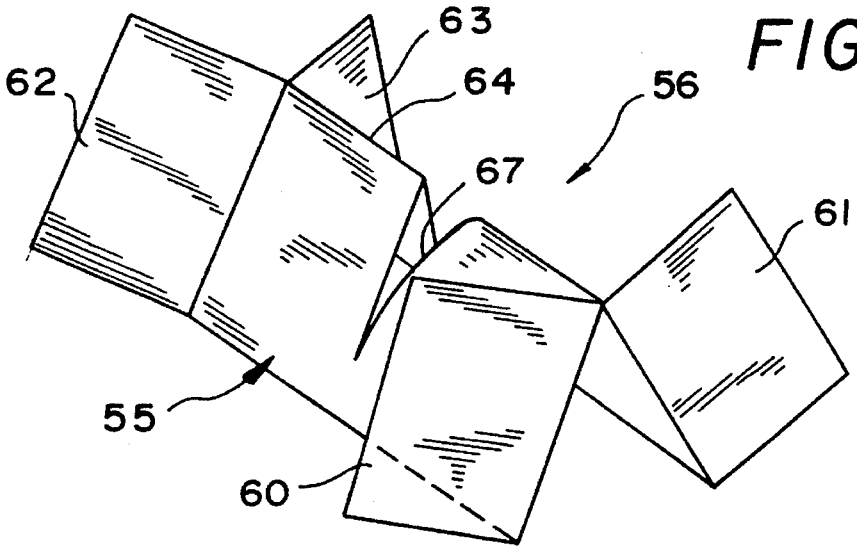
FIG. 7
FIG. 8
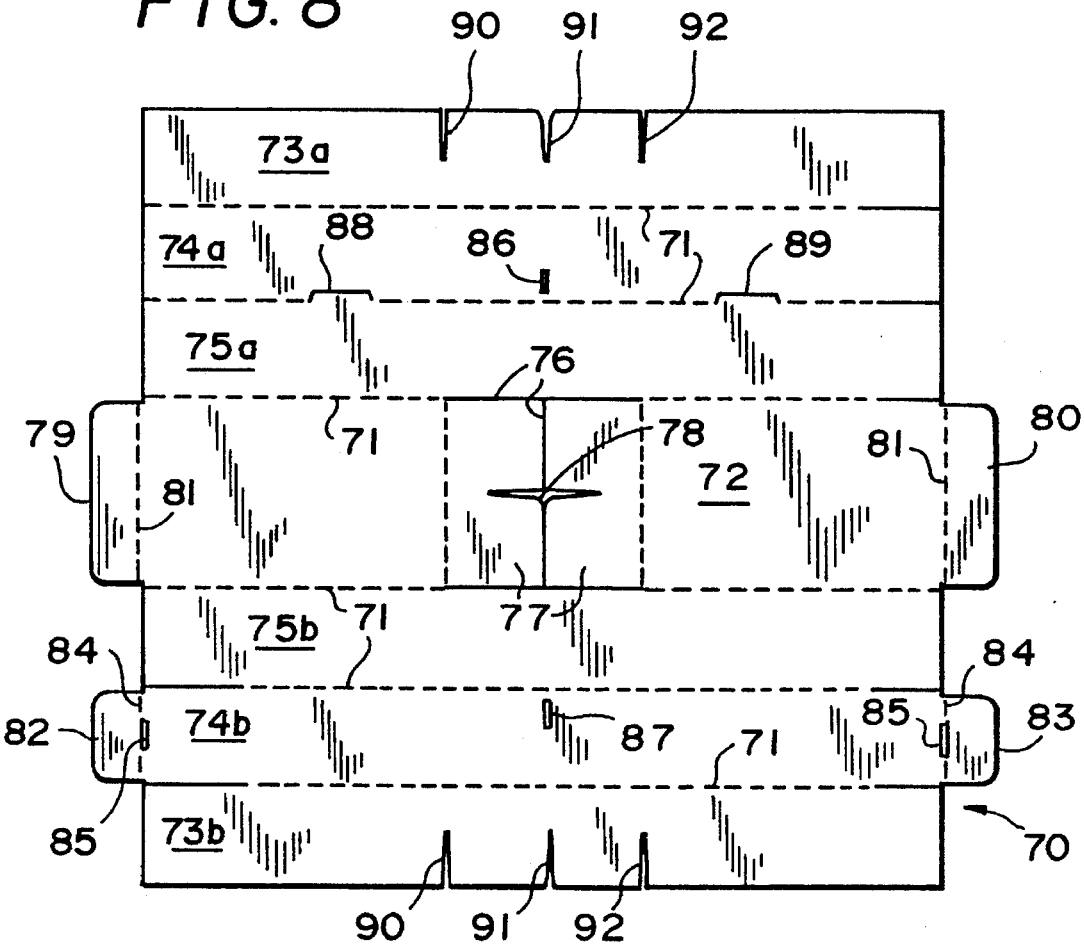

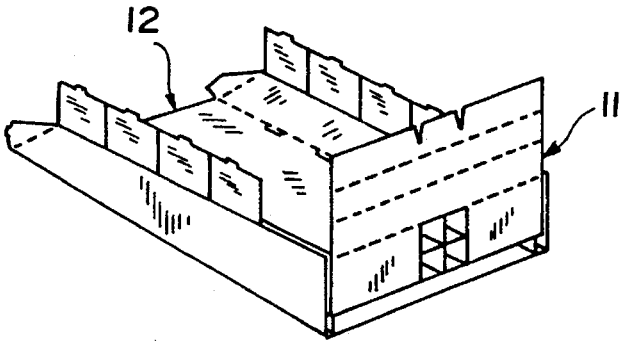
FIG. 12
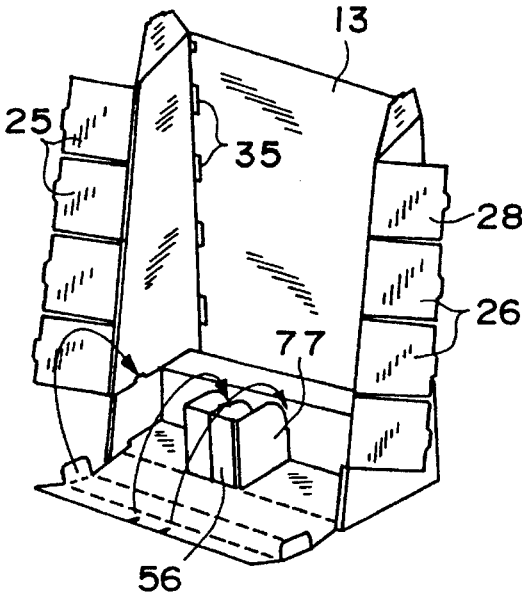
FIG. 13
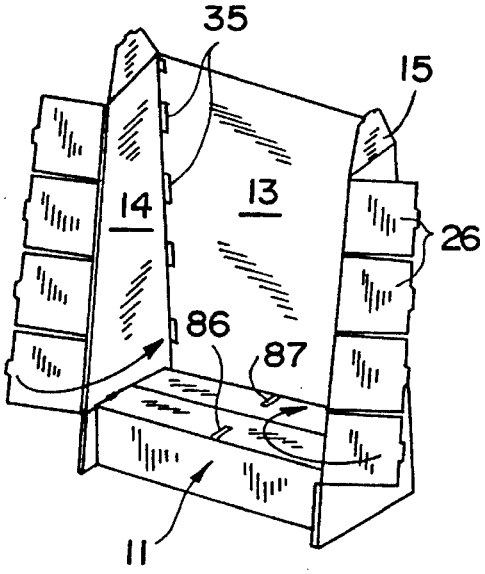
FIG. 14
FIG. 15
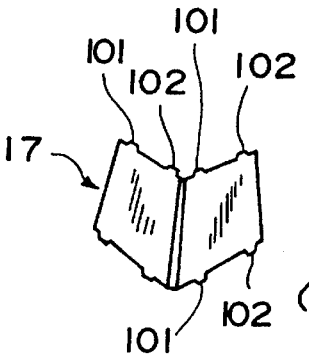
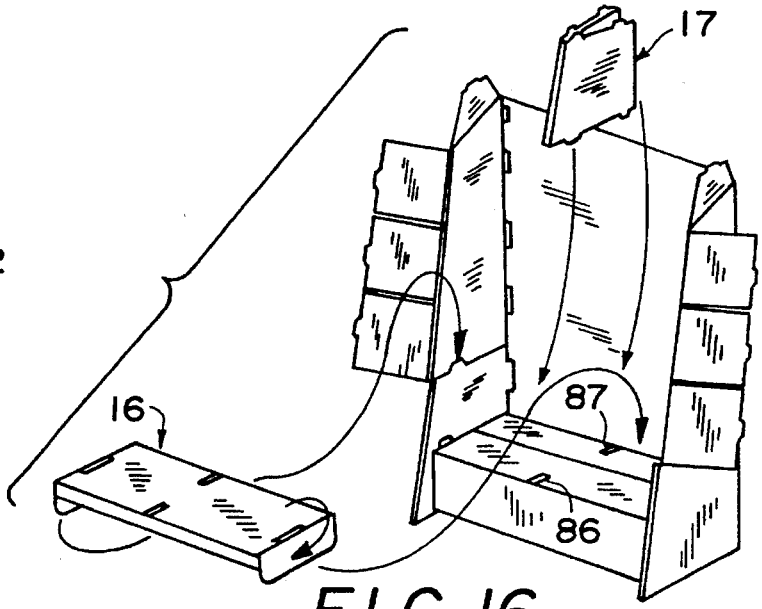
FIG. 16

DISPLAY SHELF UNIT

FIELD OF THE INVENTION

This invention relates to display racks, and, more particularly, to a display shelf assembly formed from folded blanks of corrugated liner board for economy and strength.

DESCRIPTION OF THE PRIOR ART

Many different types and styles of display racks are known in the art for displaying merchandise at the point of sale. Conventional display racks range from metal units to assemblies made from paperboard and/or other materials.

Metal units are relatively expensive and heavy and are generally pre-asssembled by the manufacturer, or are shipped to the merchandiser in partially assembled form, thereby requiring excessive shipping space. Moreover, some merchandisers do not exercise care in the handling and use of the display racks and damage or dispose of them after only a short period of use. Because of the relatively high cost of metal display racks, this activity increases the cost to the merchandiser or to the vendor who supplies the racks for display of its products.

Prior art display racks made from paperboard and similar materials are relatively complex and expensive in construction, and/or do not possess adequate strength. For instance, the racks are frequently used for products not intended to be displayed on the rack and the rack may fail or sag if much heavier product is displayed than was intended during the design of the rack.

Further, although paperboard display racks may be shipped to the merchandiser in unassembled form, typically flat blanks of material which must be folded and assembled together to construct a completed display rack, the assembly may be difficult for a novice to accomplish. Additionally, many prior art racks of this type may have inadequate display space or may obscure the displayed merchandise behind components of the display rack itself.

Accordingly, there is need for a display rack which is inexpensive and simple in construction and which possesses superior strength, while at the same time affording maximum visibility to the displayed merchandise. Further, there is need for such a display rack which may be shipped to the point of sale in unassembled form and quickly and easily assembled by the merchandiser.

DESCRIPTION OF THE INVENTION

The invention comprises a display shelf unit formed of corrugated liner board, having a plurality of spaced shelves extending between side supports so that there is maximum exposure of the merchandise supported and displayed on the shelves. The display shelf unit of the invention is inexpensive and is easy to assemble, and yet it is stronger than comparable conventional display units made from paperboard, and is even stronger than many conventional display units in which metal components are used.

The shelf unit is shipped in unassembled form, comprising only five separate components that may be quickly and easily assembled at the point of use. The components include flat blanks that are folded to form structural subassemblies, which are then secured together by use of tabs and slots, eliminating the need for separate fasteners such as staples, glue or tape.

More particularly, the display shelf unit of the invention comprises a footer made by folding a blank into a rectilinear configuration having a center support. A base is then constructed from a blank by folding side panels perpendicular to a back and further folding shelf support flaps inwardly over the side panels in parallel relationship thereto to define pockets for receiving tabs on the footer. The flaps on the side panels additionally form a plurality of generally vertically aligned pockets for receiving downturned tabs on the ends of shelf units that are engaged between the side panels. Shelf supports are provided by partition members that extend between adjacent shelves at approximately the midportion of the shelves. Tabs are also engaged between the back panel of the base and the shelves to further brace the back panel and shelves.

The display shelf unit of the invention may be used singly as a freestanding end cap display, or two units may be placed back-to-back, or four units may be arranged together to form an island display, with each of the four units facing outwardly in a different direction.

Because of the superior strength of the display rack of the invention, it may safely be used to display relatively heavy products, including some products that are not intended for the rack. Moreover, if the rack of the invention becomes damaged or no longer useful it may be discarded at an insignificant cost to the merchandiser or vendor whose goods are intended to be displayed on the rack.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein:

FIG. 7 is a top perspective view of the H-divider of FIG. 6, shown in partially folded condition;

FIG. 8 is a plan view of the blank used to form the footer used in the display shelf unit of the invention;

FIG. 12 is a bottom perspective view of the base and footer in assembled relationship, showing the base lying on its back;

FIG. 13 is a front perspective view of the footer and base in an upright position, showing how the footer is folded to complete the subassembly;

FIG. 14 is a front perspective view of the footer and base in their upright, assembled condition;

FIG. 15 is a front perspective view of the partially folded shelf support member;

FIG. 16 is an exploded front perspective view of the assembled footer and base, illustrating how a shelf unit and shelf support are assembled to the support subassembly;

DETAILED DESCRIPTION OF THE PREFERRED EMBODIMENTS

Figure 1:
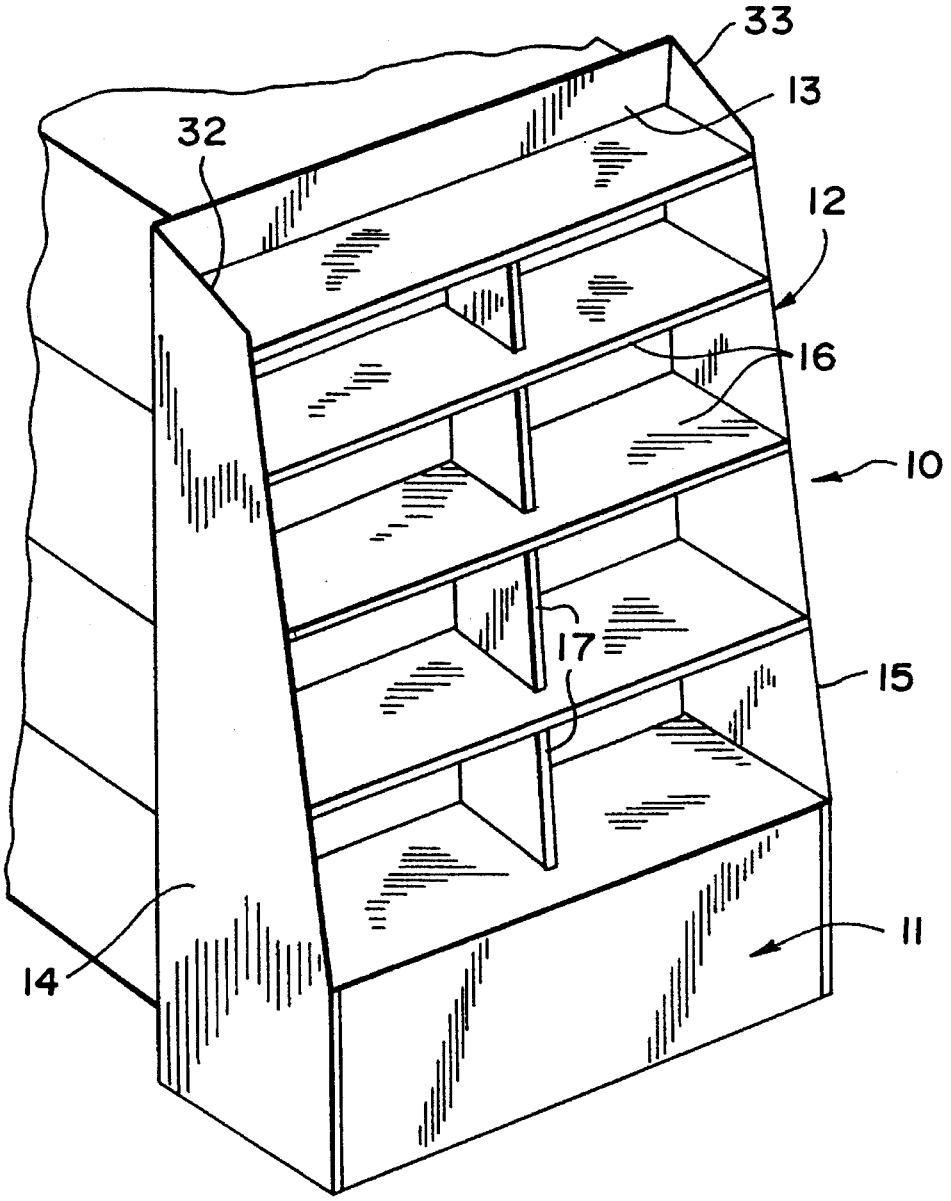
FIG. 1 is a front perspective view of one of the display shelf units of the invention.

Referring more particularly to the drawings, a single freestanding display shelf unit according to the invention is indicated generally at 10 in FIG. 1. The display shelf unit includes a footer 11 and base 12 including a back panel 13 and spaced parallel side panels 14 and 15, with a plurality of generally vertically aligned, spaced apart, horizontal shelves 16 extending between the side panels 14 and 15. Vertically oriented shelf supports 17 extend between adjacent shelves at their midportion to support the shelves and lend strength to the assembly. A plurality of the display shelf units 10 are shown arranged together to form an island display 20 in FIG. 2.

Figure 3:
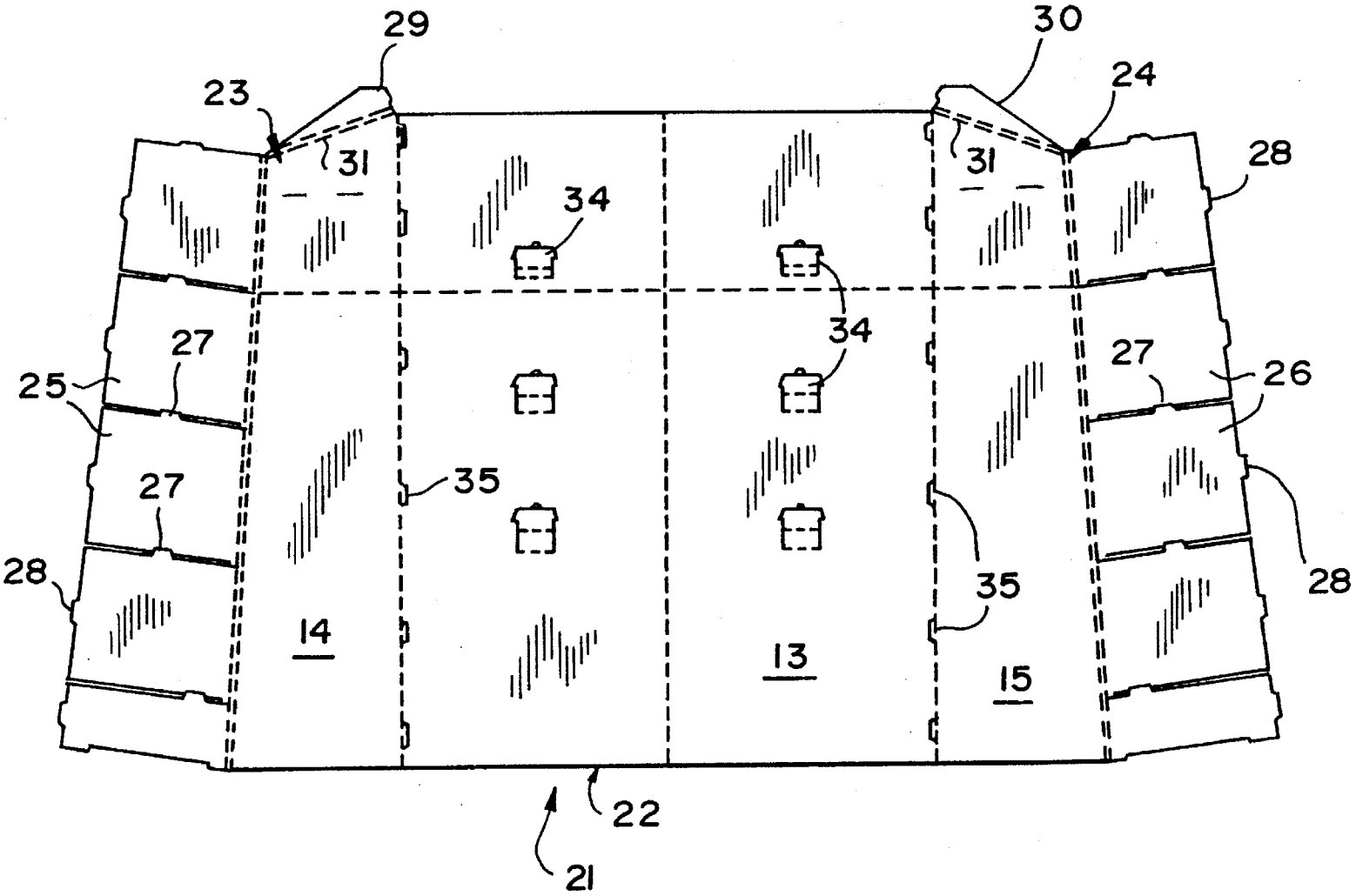
FIG. 3 is a plan view of the blank used to form the base of the display shelf unit of the invention.

With reference to FIG. 3, a blank 21 for making one size base 12 comprises a single large flat sheet of corrugated liner board. The blank is approximately ⅛ inch thick and has overall dimensions of 111¼ inches wide and 63⅞ inches high. It includes a rectangular center section 22 which defines the back panel 13, and opposite side sections 23 and 24 which define the side panels 14 and 15. A plurality of foldable flaps 25 extend outwardly and upward at a slight angle from the outer edge of one side panel 14, and a corresponding plurality of foldable flaps 26 extend outwardly at a slight upward angle from the opposite side panel 15. Each of the foldable flaps 25 and 26 is formed with a protruding tab 27 on its upper edge and a protruding tab 28 on its outer free end, for a purpose to be described later. The upper ends of the side panels 14 and 15 have foldable tabs 29 and 30 joined thereto along inclined fold lines 31, which result in angled upper edges 32 and 33 on the folded side panels, and serve to engage the uppermost shelf in the assembled display rack, as described later. Additionally, foldable tabs 34 are formed in the back panel in positions corresponding to the location of the rear edges of the shelves when assembled to the base, for a purpose described later, and tab-receiving slots 35 are formed through the back panel adjacent the fold lines joining the side panels to the back panel, for receiving the end tabs 28 on the foldable flaps 25 and 26 when the flaps are folded inwardly over the side panels, as described later and as shown in FIGS. 11, 14, 17 and 18.

Figure 4:
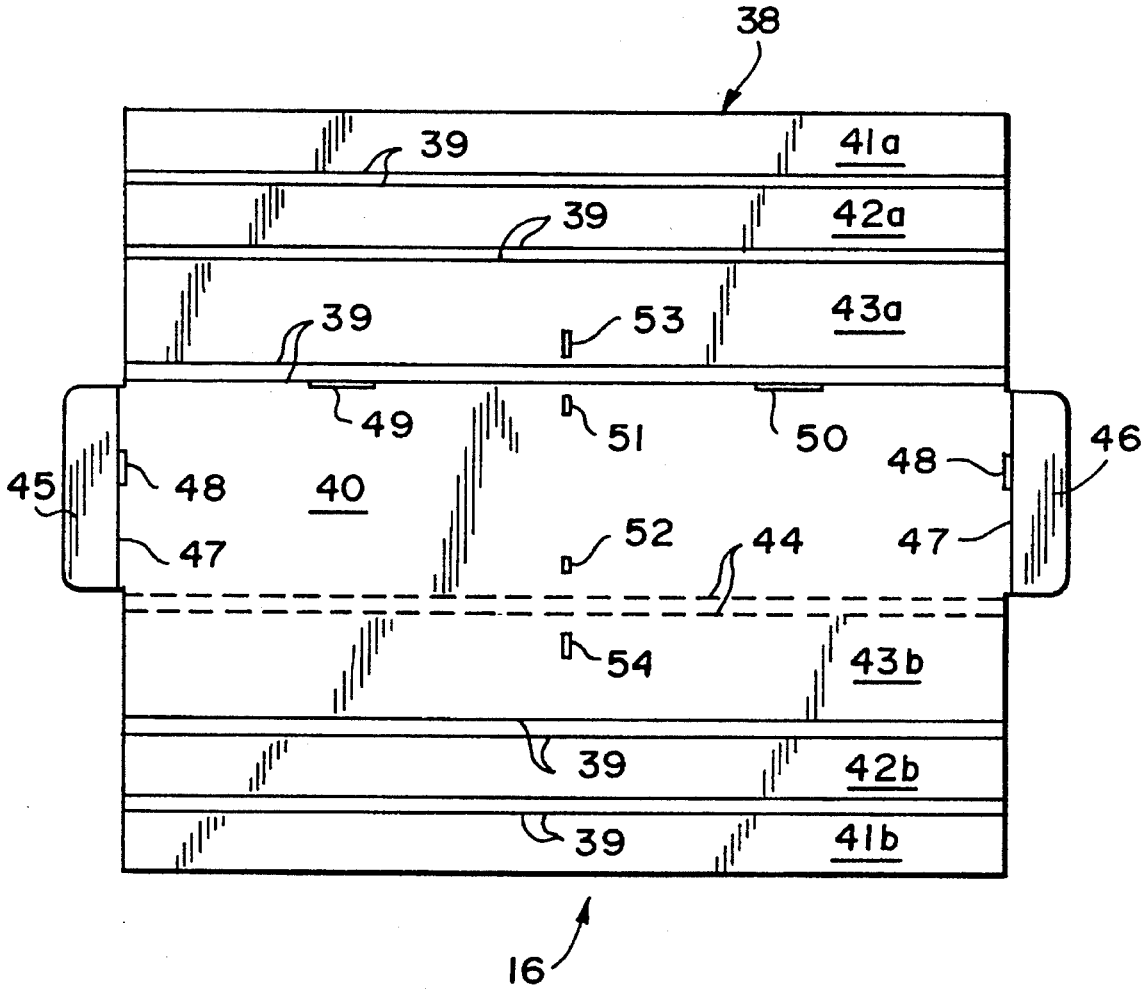
FIG. 4 is a plan view of the blank used to form a shelf used in the display unit of the invention.

With reference to FIG. 4, each shelf 16 is formed from a large flat rectangular blank 38 longitudinally divided by perforated score lines 39 into a center panel 40 which forms the shelf support surface, and first, second and third panels 41*a*, 42*a* and 43*a*, respectively, along one longitudinal side edge of the center panel 40, and first, second and third panels 41*b*, 42*b* and 43*b*, respectively, along the other longitudinal side edge. It should be noted, however, that the innermost, third panel 43*b* along one edge of the center panel is joined to the center panel by regular score lines 44 that do not perforate the liner board. This results in that edge having a finished appearance when the panels are folded to form the shelf, and that finished edge serves as the outer exposed edge of the shelf in the finished assembly. Foldable flaps 45 and 46 are joined along fold lines 47 to the outer opposite ends of the center panel 40, for a purpose to be described later. The center panel 40 has a slot 48 formed through each end thereof just inside the fold lines 47, slots 49 and 50 along one side edge just inside the score lines 39, and a pair of transversely oriented slots 51 and 52 spaced just inside the score lines 39 and 44 at opposite side edges of the center panel approximately between its opposite ends. A pair of slots 53 and 54 extend through the edge of the panels 43 at opposite sides of the center panel, in positions to be in registry with the slots 51 and 52 when the first, second and third panels are folded into operative relationship with the center panel, as illustrated in FIG. 5.

Figure 5:
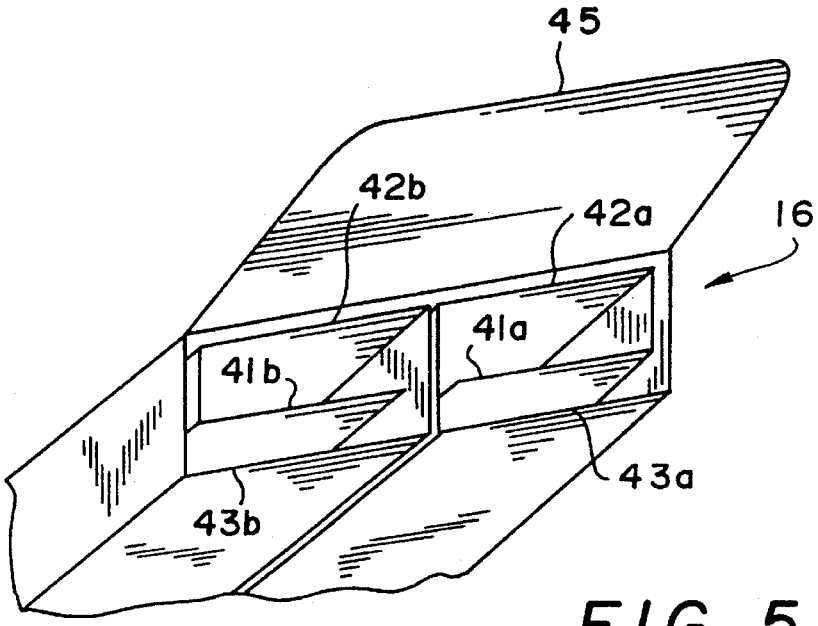
FIG. 5 is an enlarged, bottom perspective end view of the shelf of FIG. 4, shown in its folded condition ready for use.

With further reference to FIG. 5, the shelf 16 is folded and glued as shown prior to being shipped to the merchandiser, i.e., first panel 41 is folded over second panel 42 and glued, and these folded and glued panels are then folded over the third panel 43 and glued. These folded panels at opposite side edges of the center panel 40 are then folded inwardly toward each other over the center panel and glued to the center panel, thus forming a four ply corrugated structure for the shelf.

Figure 6:
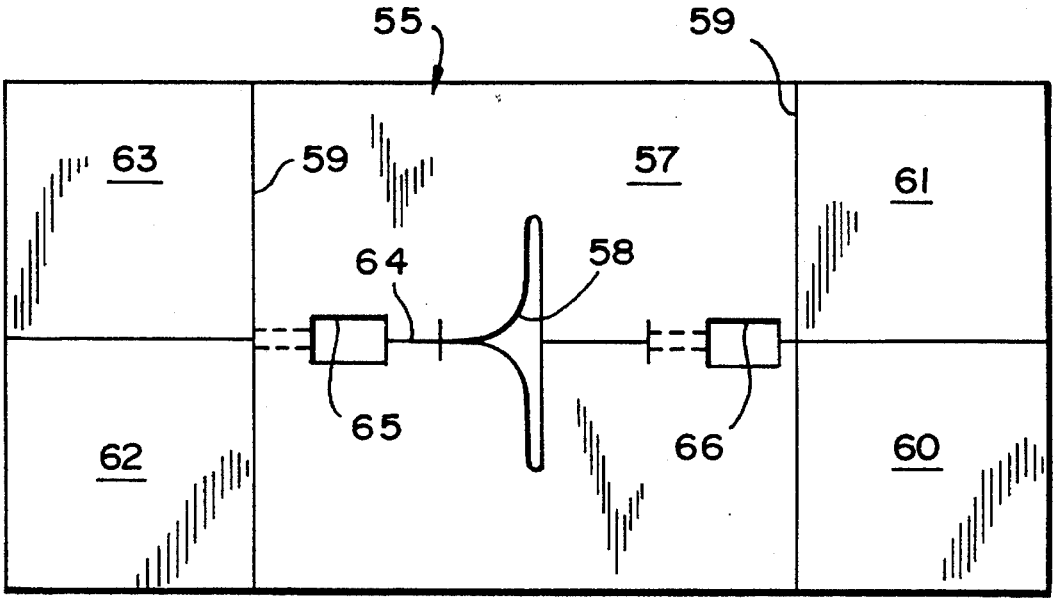
FIG. 6 is a plan view of the blank used to form the H-divider used in the footer of the display shelf unit of the invention.

FIGS. 6 and 7 show the blank 55 for forming an H-divider 56 that aids in the assembly of the footer 11 and provides reinforcement for the footer. The blank includes a center panel 57 with a shaped cutout 58 extending through approximately its midportion and transverse fold lines 59 extending across its opposite ends and defining four axially extending flaps 60, 61, 62 and 63. A fold line 64 also extends along the longitudinal center line of the blank, and a pair of slots 65 and 66 are formed through the blank on this centerline near the opposite ends of the center panel. During assembly, the H-divider is folded along its longitudinal fold line 64 as shown in FIG. 7, with the shaped cutout defining a notch 67 having one side extending substantially vertically from the longitudinal fold line and the other side extending arcuately from the fold line to the bottom of the notch, and the four flaps 60–63 projecting laterally outwardly to form the H-shaped divider.

The blank for making the footer 11 is indicated generally at 70 in FIG. 8, and comprises a flat, rectangular sheet of corrugated liner board divided by a plurality of longitudinally extending fold lines 71 into a center panel 72 and first, second and third panels 73*a*, 74*a* and 75*a*, respectively, on one side of the center panel, and first, second and third panels 73*b*, 74*b* and 75*b*, respectively, on the other side of the center panel. Cuts 76 are made through the midportion of the center panel to form a pair of flaps 77 that may be folded upwardly from the plane of the panel, with the free edge of each flap having a shaped notch 78 therein corresponding in size, shape and orientation to the notch 67 formed in the H-divider. A pair of longitudinally projecting flaps 79 and 80 are joined to the opposite ends of the center panel along fold lines 81, and pair of narrower flaps 82 and 83 are joined to the opposite ends of the second panel 74*b* along fold line 84. A transverse notch 85 is formed through each end of the second panel 74*b*, and additional transverse notches 86 and 87 are formed through the panels 74*a* and 74*b* at approximately their midportions and near their innermost edge. Cuts in the panel 74*a* define a pair of transversely projecting tabs 88 and 89. The outer edges of the first panels 73*a* and 73*b* at opposite sides of the blank are slit to define a plurality of notches 90, 91 and 92 extending inwardly partially across the width of the respective panel, for cooperation with the H-divider 56 and the flaps 77, as described hereinafter.

Figure 9:
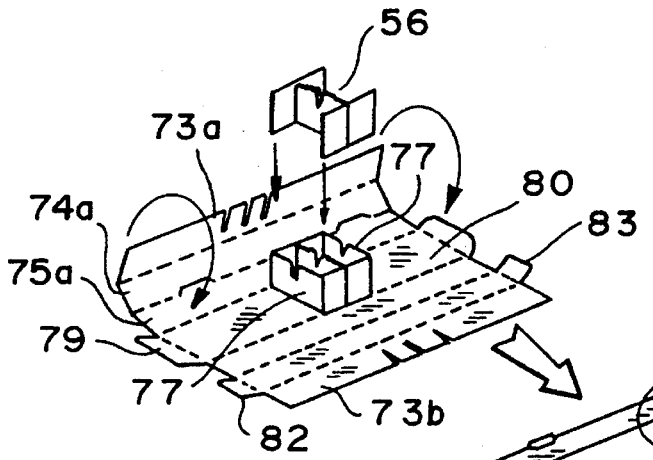
FIG. 9 is an exploded top perspective view of the H-divider and footer, showing how these two components are assembled together to form a structural subassembly for supporting the base.
Figure 10:
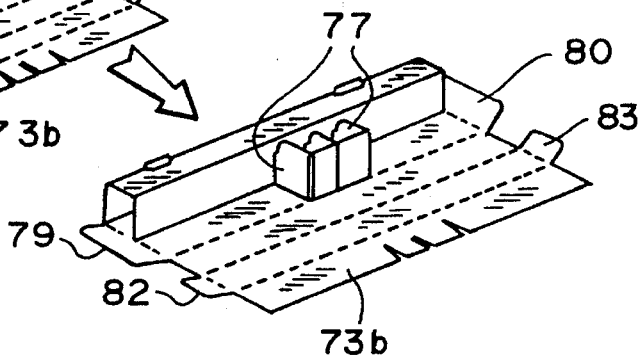
FIG. 10 is a top perspective view of the H-divider and footer in their assembled condition.

To assemble the display shelf unit of the invention, the footer blank 70 is placed on a supporting surface, the flaps 77 are folded upwardly perpendicular to the plane of the blank, and the H-divider 56 is set between the flaps 77 so that the flaps are held in upright position, as illustrated in FIG. 9. The first, second and third panels 73*a*, 74*a* and 75*a* at one side of the blank are then folded upwardly and inwardly over the H-divider, with the outer notched edge of the first panel 73 inserted into the shaped notch 67 of the H-divider and the shaped notches 78 in the upper, free edges of the flaps 77, forming the structure shown in FIG. 10.

Figure 11:
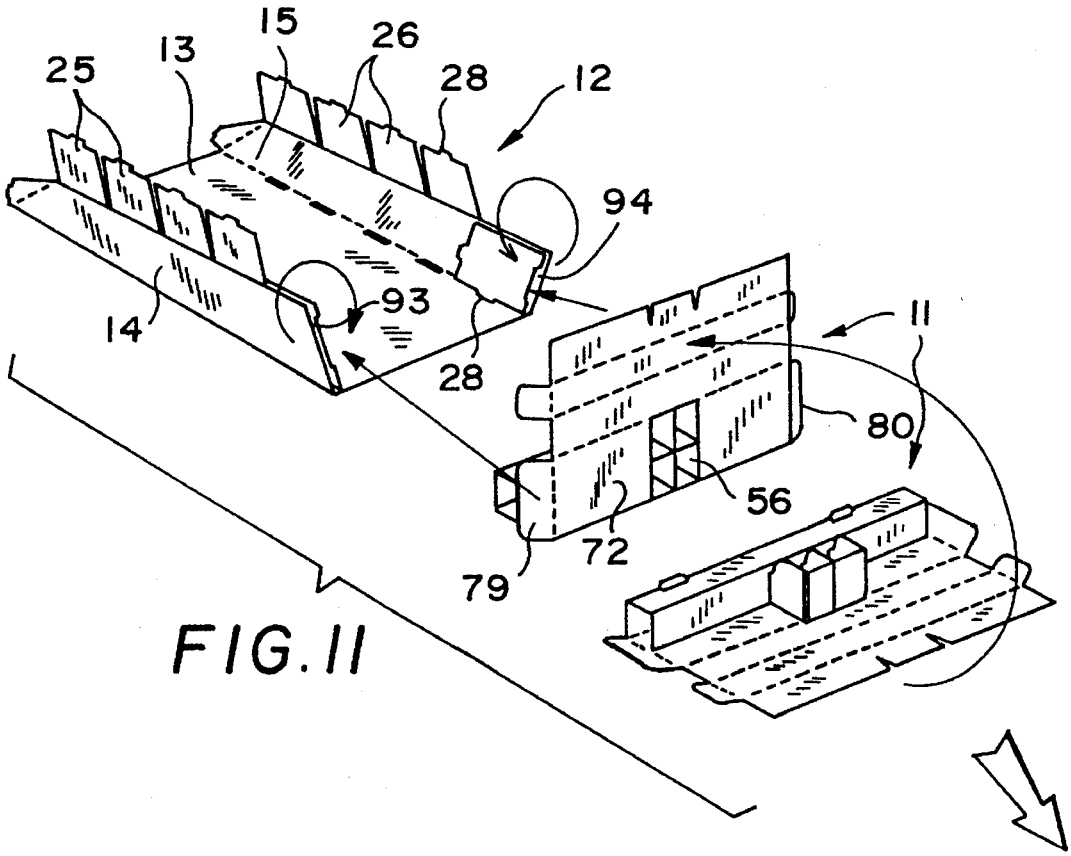
FIG. 11 is an exploded bottom perspective view of the footer and base, showing the base lying on its back and illustrating how the footer and base are assembled together to form the structural subassembly for supporting the shelves.
Figure 17:
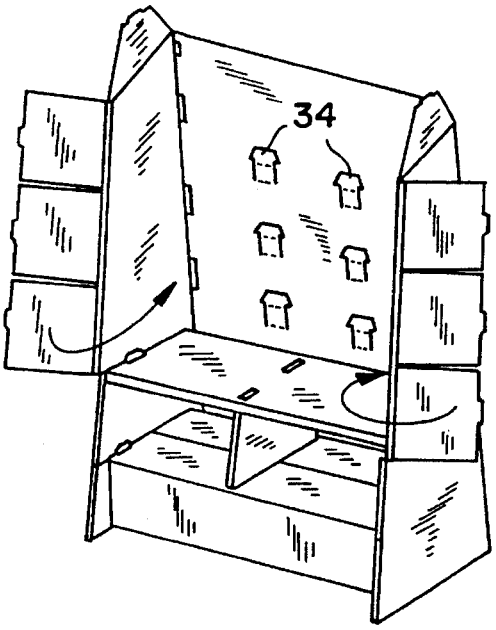
FIG. 17 is a front perspective view of the footer and base, with one shelf and shelf support assembled thereto, and illustrating how the side flaps are folded to form pockets for receiving end tabs on the shelves.

The base 12 is then placed flat on the supporting surface and the side panels 14 and 15 are folded upwardly, as shown in FIG. 11. The bottom-most flaps 25 and 26 on the side panels are then folded inwardly over the side panels and the tabs 28 on the free ends of the flaps are inserted into aligned slots 35 formed through the back panel 13 to hold the flaps in this folded position and define pockets 93 and 94 between the respective flaps and associated side panels.

The flaps 79 and 80 on the ends of the center panel 72 of footer 11 are then inserted into a respective pocket 93 and 94 from the bottom end of the base, and the first, second and third panels 73*b*, 74*b* and 75*b* at the other side of the footer are folded upwardly and inwardly, with the first panel 73*b* tucked downwardly into the notched H-divider in parallel, contiguous relationship with panel 73*a*, and the tabs 27 on the upper edges of flaps 25 and 26 extended into the slots 85 in the footer. During this operation, the tabs 82 and 83 on panel 74*b* are inserted downwardly into the tops of the pockets 93 and 94 defined between flaps 25 and 26 and the respective side panels. See FIGS. 11, 12 and 13.

A shelf support 17 is then folded from a blank 100 as indicated in FIG. 15, defining a generally rectangularly shaped member having a pair of tabs 101 and 102 projecting from each of its upper and lower edges. The shelf support is positioned on the assembled footer, with the tabs 101 and 102 on the bottom of the support engaged in the slots 86 and 87 in the top of the footer 11.

Following assembly of the footer and shelf support to the base as described above, the next adjacent pair of flaps 25 and 26 on the side panels 14 and 15 are folded inwardly against the respective side panels, and the tabs 28 at the free ends of the flaps are inserted into respective slots 35 in the back panel to hold the flaps in folded position and define a further pair of pockets 93 and 94.

One of the shelf units 16 is then assembled to the base by tucking the flaps 45 and 46 on the ends of the shelf into the respective pockets 93 and 94, with the tabs 27 on the upper edges of the flaps 25 and 26 engaged in the slots 48, and tabs 101 and 102 on the shelf support engaged in the slots 53 and 54 on the underside of the shelf 16.

Figure 18:
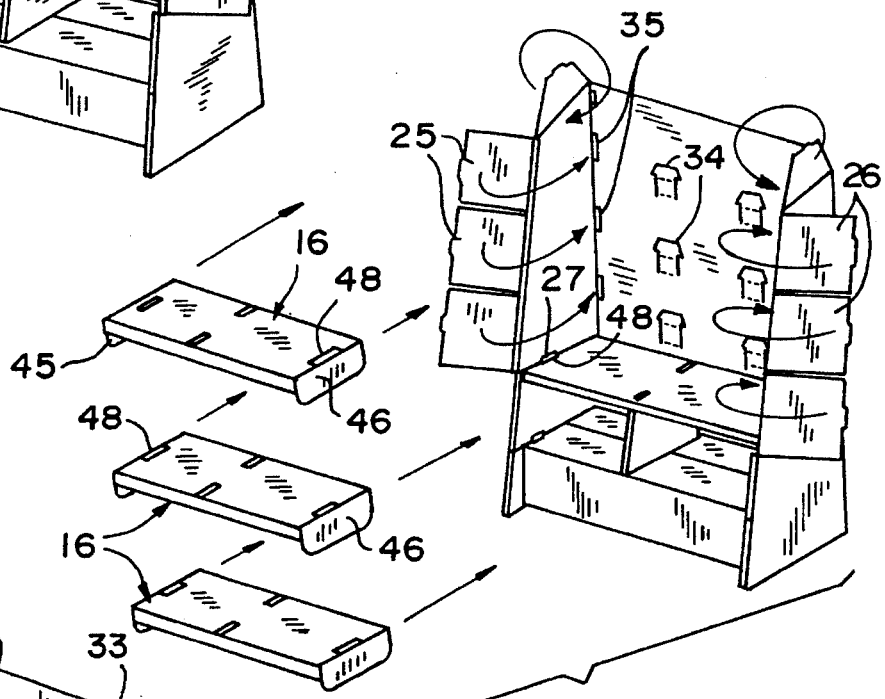
FIG. 18 is an exploded front perspective view of the assembled footer and base, showing one shelf and its support in assembled relationship, and illustrating how additional shelves are added.
Figure 19:
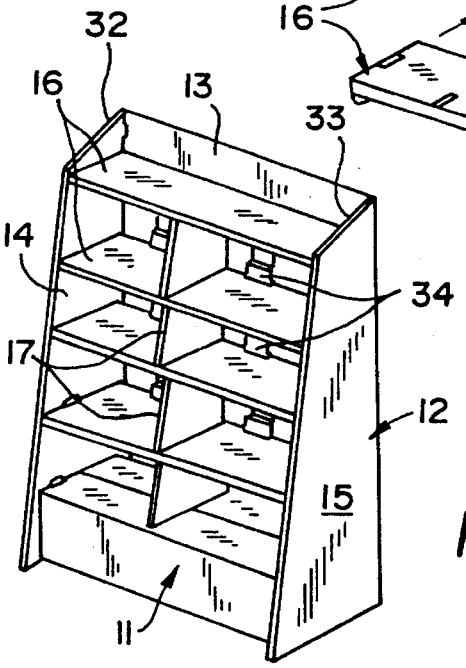
FIG. 19 is a front perspective view of a completed display shelf unit according to the invention.

Successive pairs of flaps 25 and 26 are folded and locked in position by means of the interengaged tabs and slots, defining successive pockets 93 and 94, to which successive shelf units 16 are sequentially assembled, as depicted in FIG. 18.

Figure 2:
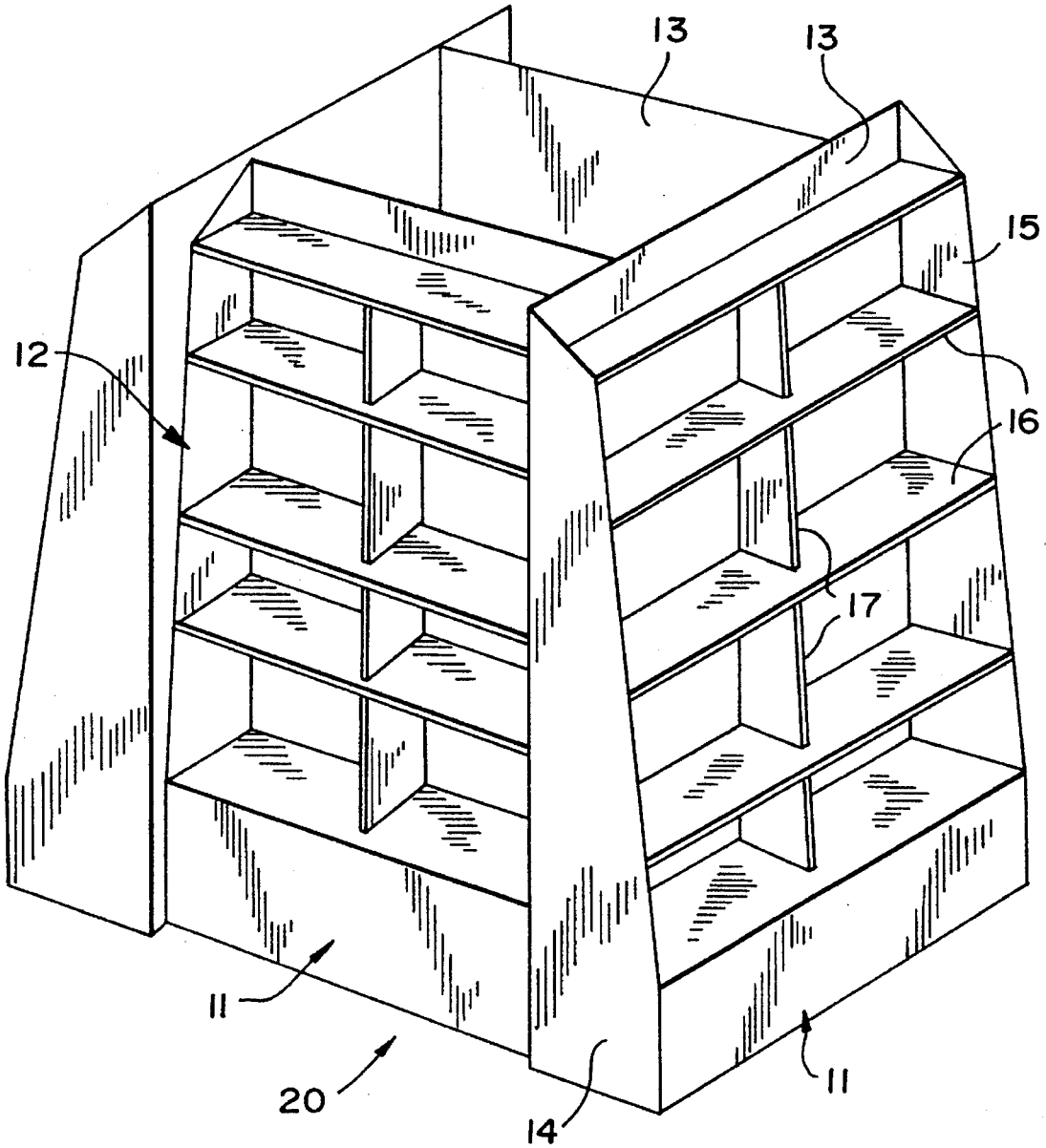
FIG. 2 is a top perspective view of four of the display shelf units of the invention assembled together to form a display island.

Following assembly of the shelf units 16 to the base 12, the tabs 34 in the back panel are pulled outwardly and then folded down to insert them into the slots 49 and 50 along the back edge of each shelf. Thus assembled, the display shelf unit of the invention is highly stable and can support substantial weight. Moreover, the display shelf unit is economical to make and use, and may be knocked down or disassembled for storage or shipment, or discarded, if desired. It may be assembled by one person in approximately five to seven minutes, and in one configuration has a height of about 54 inches, a width of about 48 inches and a depth of about 16 inches. It affords great display flexibility, and a single unit may be used as a freestanding end cap display, two units may be arranged back-to-back, and four units may be arranged as shown in FIG. 2 to form an island display. In spite of its strength and simplicity, the display shelf unit of the invention costs less than many comparable units presently available.

What is claimed is:

1. A display shelf unit, comprising:

a base having a generally upright back panel with opposite side edges, a side panel extending forwardly from each of the opposite side edges of the back panel and terminating in a forward free edge, at least one foldable flap on the free edge of each side panel, said at least one flap folded inwardly and rearwardly toward said back panel in parallel relationship to the respective side panel and secured in folded position to define a pocket between said at least one flap and its associated side panel, said at least one flap having a free end positioned closely adjacent the back panel when said at least one flap is held in its secured, folded position, and interengaged tab and slot means on the free end of said at least one flap and the back panel to hold said at least one flap in its secured, folded position; and at least one shelf unit extending between the side panels and having a downturned flap on each of its opposite ends adapted to be tucked into a respective pocket at each of the side panels to hold the shelf in generally horizontal, supported position between the side panels.

2. A display shelf unit as claimed in claim 1, wherein:

there are a plurality of shelf units extending between the side panels in generally parallel, vertically spaced relationship to one another; and a shelf support extends between adjacent shelves at approximately the midportion thereof.

3. A display shelf unit as claimed in claim 2, wherein:

said base and shelf units are formed of corrugated liner board.

4. A display shelf unit as claimed in claim 1, wherein:

each folded flap on the respective side panels has a projecting tab that is engaged in a slot in an adjacent end portion of each shelf unit.

5. A display shelf unit as claimed in claim 4, wherein:

said shelf supports each comprise a generally rectangularly shaped member extending mutually perpendicular to the planes of the back panel and the shelf units; and said supports each have upper and lower edges with projecting tabs thereon engaged in slots in adjacent shelf units.

6. A display shelf unit as claimed in claim 5, wherein:

at least one foldable tab is on the back panel in a position corresponding to the location of each shelf unit; and each shelf unit has a rear edge adjacent the back panel, said rear edge having a slot in which the foldable tab on the back panel is received.

7. A display shelf unit as claimed in claim 6, wherein:

each shelf unit is formed from a corrugated liner board blank folded along multiple, parallel fold lines to define a plurality of panels, said panels being folded into parallel, overlying relationship to one another to form multiple layers.

8. A display shelf unit as claimed in claim 7, wherein:

the side panels extend forwardly from the back panel of the base in essentially perpendicular relationship thereto; and a footer is engaged between the side panels and back panel at a lower end thereof, said footer comprising a rectilinear member having flaps at its opposite ends engaged upwardly into a bottom-most pocket formed by the folded flaps on the side panels.

9. A display shelf unit as claimed in claim 8, wherein:

said footer is an elongate, rectangularly shaped box-like member folded from a single blank of corrugated liner board, and the base is engaged over the footer, with the back panel of the base lying alongside one longitudinal side of the footer and the side panels of the base lying alongside a respective opposite end of the footer, said footer having a flat upper surface defining a shelf-like supporting surface.

10. A display shelf unit as claimed in claim 9, wherein: said base, footer and shelf units are each formed from individual flat blanks of corrugated liner board, and assembled in situ to form the display unit.

11. A display shelf unit as claimed in claim 9, wherein:

a support member is engaged in the box-like footer, at approximately its midportion, to reinforce the footer.

12. A display shelf unit as claimed in claim 1, wherein:

said base and at least one shelf unit are formed of corrugated liner board.

13. A display shelf unit as claimed in claim 1, wherein:

there are a plurality of flaps on each side panel folded inwardly alongside the respective side panel to define a plurality of generally vertically aligned pockets; and there are a plurality of shelf units extending between the side panels in generally parallel, vertically spaced relationship to one another; and a shelf support extends between adjacent shelves at approximately the midportion thereof.

14. A display shelf unit as claimed in claim 13, wherein:

each shelf unit is formed from a corrugated liner board blank folded along multiple, parallel fold lines to define a plurality of panels, said panels being folded into parallel, overlying, contiguous relationship to one another to form multiple layers.

15. A display shelf unit as claimed in claim 14, wherein:

the side panels extend forwardly from the back panel of the base in essentially perpendicular relationship thereto; and a footer is engaged between the side panels and back panel at a lower end thereof, said footer comprising a rectilinear member having flaps at its opposite ends engaged upwardly into a bottom-most pocket formed by the folded flaps on the side panels.

16. A display shelf unit as claimed in claim 14, wherein:

the fold lines in said corrugated liner board blank are perforated to facilitate bending of the panels along the fold lines, except those fold lines defining a front, exposed edge of the shelf unit when the assembly is completed, and those fold lines comprise normal scores, whereby the exposed edge of the shelf unit has a finished appearance.

17. A display shelf unit, comprising:

a base having a generally upright back panel and a pair of spaced apart, opposed side panels extending forwardly from the back panel; and at least one shelf unit of high load-carrying capacity extending between and supported on the side panels in generally horizontal position between the side panels and in front of the back panel, said shelf unit being formed from a flat rectangular blank longitudinally divided by fold lines into a center panel and a plurality of secondary panels along each of opposite longitudinal side edges of the center panel, said plurality of secondary panels each having a width less than the width of the center panel and being successively folded inwardly over one another from each of the respective opposite longitudinal side edges of the center panel into parallel, contiguous relationship with each other and with the center panel, whereby the center panel forms an unbroken shelf support surface on which items may be supported, and the secondary panels form multiple box beam structures beneath the center panel to support it.

18. A display shelf unit as claimed in claim 17, wherein:

the fold lines dividing the blank into a plurality of panels comprise perforated score lines, and the secondary panels comprise first, second and third panels, respectively, along one longitudinal side edge of the center panel, and first, second and third panels, respectively, along the other longitudinal side edge of the center panel, the innermost, third panel along one edge of the center panel being joined to the center panel by non-perforated score lines so that when the panels are folded to form the shelf unit, the edge having the non-perforated score lines is oriented outwardly relative to the base and presents a finished appearance in the finished assembly.

* * * * *